US011293230B2

(12) United States Patent
Nanayakkara et al.

(10) Patent No.: US 11,293,230 B2
(45) Date of Patent: Apr. 5, 2022

(54) ROTARY STEERABLE TOOL WITH INDEPENDENT ACTUATORS

(71) Applicant: Halliburton Energy Services, Inc., Houston, TX (US)

(72) Inventors: Ravi P. Nanayakkara, Kingwood, TX (US); Larry D. Chambers, Kingwood, TX (US); Brian Doud, Spring, TX (US); Neelesh V. Deolalikar, Houston, TX (US); Michael D. Finke, Cypress, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 16/963,335

(22) PCT Filed: Feb. 19, 2018

(86) PCT No.: PCT/US2018/018617
§ 371 (c)(1),
(2) Date: Jul. 20, 2020

(87) PCT Pub. No.: WO2019/160562
PCT Pub. Date: Aug. 22, 2019

(65) Prior Publication Data
US 2021/0062585 A1 Mar. 4, 2021

(51) Int. Cl.
*E21B 7/06* (2006.01)

(52) U.S. Cl.
CPC ..... *E21B 7/065* (2013.01)

(58) Field of Classification Search
CPC ..... E21B 7/06
See application file for complete search history.

(56) References Cited

U.S. PATENT DOCUMENTS 4,947,944 A * 8/1990 Coltman ..... E21B 7/062 175/325.3
5,439,064 A * 8/1995 Patton ..... E21B 7/04 175/24

(Continued)

FOREIGN PATENT DOCUMENTS

WO 2016187373 A1 11/2016
WO 2017065724 A1 4/2017
WO 2018017092 A1 1/2018

OTHER PUBLICATIONS

International Search Report and Written Opinion dated Jan. 11, 2019, for the PCT application PCT/US2018/018617 filed on Feb. 19, 2018.

*Primary Examiner* — Shane Bomar
(74) *Attorney, Agent, or Firm* — Chamberlain Hrdlicka

(57) ABSTRACT

A rotary steerable tool for directional drilling includes a tool body including a flowbore for flowing pressurized fluid therethrough and a plurality of extendable members movably coupled to the tool body for selectively engaging a borehole wall, each extendable member including a piston for moving the extendable member to an extended position. The tool further includes a pressurized fluid supply flow path to provide fluid pressure from the flowbore to the pistons, and a plurality of linear actuators, each independently actuatable to control fluid pressure from the pressurized fluid supply flow path to a respective piston.

17 Claims, 8 Drawing Sheets

(56) References Cited

U.S. PATENT DOCUMENTS 5,452,772 A * 9/1995 Van Den Bergh ..... E21B 7/067 175/74
5,553,678 A * 9/1996 Barr ..... E21B 47/01 175/73
5,603,386 A * 2/1997 Webster ..... E21B 7/062 175/76
6,609,579 B2 * 8/2003 Krueger ..... E21B 7/068 175/26
7,784,563 B2 * 8/2010 Rodland ..... E21B 10/60 175/16
8,087,479 B2 * 1/2012 Kulkarni ..... E21B 10/62 175/73
9,016,400 B2 * 4/2015 Clausen ..... E21B 7/06 175/61
9,631,432 B2 * 4/2017 Downton ..... E21B 7/04
2004/0011525 A1 1/2004 Jones et al.
2004/0104051 A1 * 6/2004 Moriarty ..... E21B 7/20 175/57
2008/0142269 A1 6/2008 Richards et al.
2010/0025116 A1 * 2/2010 Hutton ..... E21B 7/06 175/61
2011/0147086 A1 6/2011 Hummes et al.
2012/0160565 A1 6/2012 Downton et al.
2014/0110178 A1 * 4/2014 Savage ..... E21B 7/062 175/76
2014/0169128 A1 6/2014 Orban et al.
2014/0246234 A1 * 9/2014 Gillis ..... E21B 10/083 175/24
2014/0325808 A1 * 11/2014 Qi ..... H01L 41/042 29/25.35
2018/0252088 A1 * 9/2018 Tilley ..... E21B 21/10
2019/0128071 A1 * 5/2019 Conger ..... E21B 17/1014
2019/0301244 A1 * 10/2019 Moore ..... E21B 44/00
2020/0040658 A1 * 2/2020 Mohon ..... E21B 7/062
2021/0172254 A1 * 6/2021 Deolalikar ..... E21B 17/1014
2021/0381314 A1 * 12/2021 Peters ..... E21B 7/06

* cited by examiner

ROTARY STEERABLE TOOL WITH INDEPENDENT ACTUATORS

BACKGROUND

This section is intended to provide relevant contextual information to facilitate a better understanding of the various aspects of the described embodiments. Accordingly, it should be understood that these statements are to be read in this light and not as admissions of prior art.

Directional drilling is commonly used to drill any type of well profile where active control of the well bore trajectory is required to achieve the intended well profile. For example, a directional drilling operation may be conducted when the target pay zone is not directly below or otherwise cannot be reached by drilling straight down from a drilling rig above it.

Directional drilling operations involve varying or controlling the direction of a downhole tool (e.g., a drill bit) in a borehole to direct the tool towards the desired target destination. Examples of directional drilling systems include point-the-bit rotary steerable drilling systems and push-the-bit rotary steerable drilling systems. In both systems, the drilling direction is changed by repositioning the bit position or angle with respect to the well bore. Point-the-bit technologies control a bend angle of the shaft driving rotation of the bit, which can cause the bit to steer in the direction of the bend. Push-the-bit tools typically use extendable or moveable members, such as so-called pad pushers (i.e., a pad and/or a piston), which push against the wall of the well bore causing a direction change.

Dogleg capability is the ability of a drilling system to make precise and sharp turns in forming a directional well. Higher doglegs increase reservoir exposure and allow improved utilization of well bores where there are lease line limitations. Tool face control is a fundamental factor of dogleg capability. Typically, a higher and more precise degree of tool face control increases dogleg capability. In existing systems though, the extendable members are generally not controllable independently or with respect to each other, thereby providing low resolution tool face control.

BRIEF DESCRIPTION OF THE DRAWINGS

Illustrative embodiments of the present disclosure are described in detail below with reference to the attached drawing figures, which are incorporated by reference herein and wherein.

The illustrated figures are only exemplary and are not intended to assert or imply any limitation with regard to the environment, architecture, design, or process in which different embodiments may be implemented.

DETAILED DESCRIPTION OF ILLUSTRATIVE EMBODIMENTS

A subterranean formation containing oil or gas hydrocarbons may be referred to as a reservoir, in which a reservoir may be located under land or off shore. Reservoirs are typically located in the range of a few hundred feet (shallow reservoirs) to a few tens of thousands of feet (ultra-deep reservoirs). To produce oil or gas or other fluids from the reservoir, a wellbore is drilled into a reservoir or adjacent to a reservoir.

A well can include, without limitation, an oil, gas, or water production well, or an injection well. As used herein, a "well" includes at least one wellbore having a wellbore wall. A wellbore can include vertical, inclined, and horizontal portions, and it can be straight, curved, or branched. As used herein, the term "wellbore" includes any cased, and any uncased, open-hole portion of the wellbore. A near-wellbore region is the subterranean material and rock of the subterranean formation surrounding the wellbore. As used herein, a "well" also includes the near-wellbore region. The near-wellbore region is generally considered to be the region within approximately 100 feet of the wellbore. As used herein, "into a well" means and includes into any portion of the well, including into the wellbore or into the near-wellbore region via the wellbore.

A portion of a wellbore may be an open-hole or cased-hole. In an open-hole wellbore portion, a tubing string may be placed into the wellbore. The tubing string allows fluids to be introduced into or flowed from a remote portion of the wellbore. In a cased-hole wellbore portion, a casing is placed into the wellbore that can also contain a tubing string. A wellbore can also contain an annulus, such as, but are not limited to: the space between the wellbore and the outside of a tubing string in an open-hole wellbore; the space between the wellbore and the outside of a casing in a cased-hole wellbore; and the space between the inside of a casing and the outside of a tubing string in a cased-hole wellbore.

Figure 1:
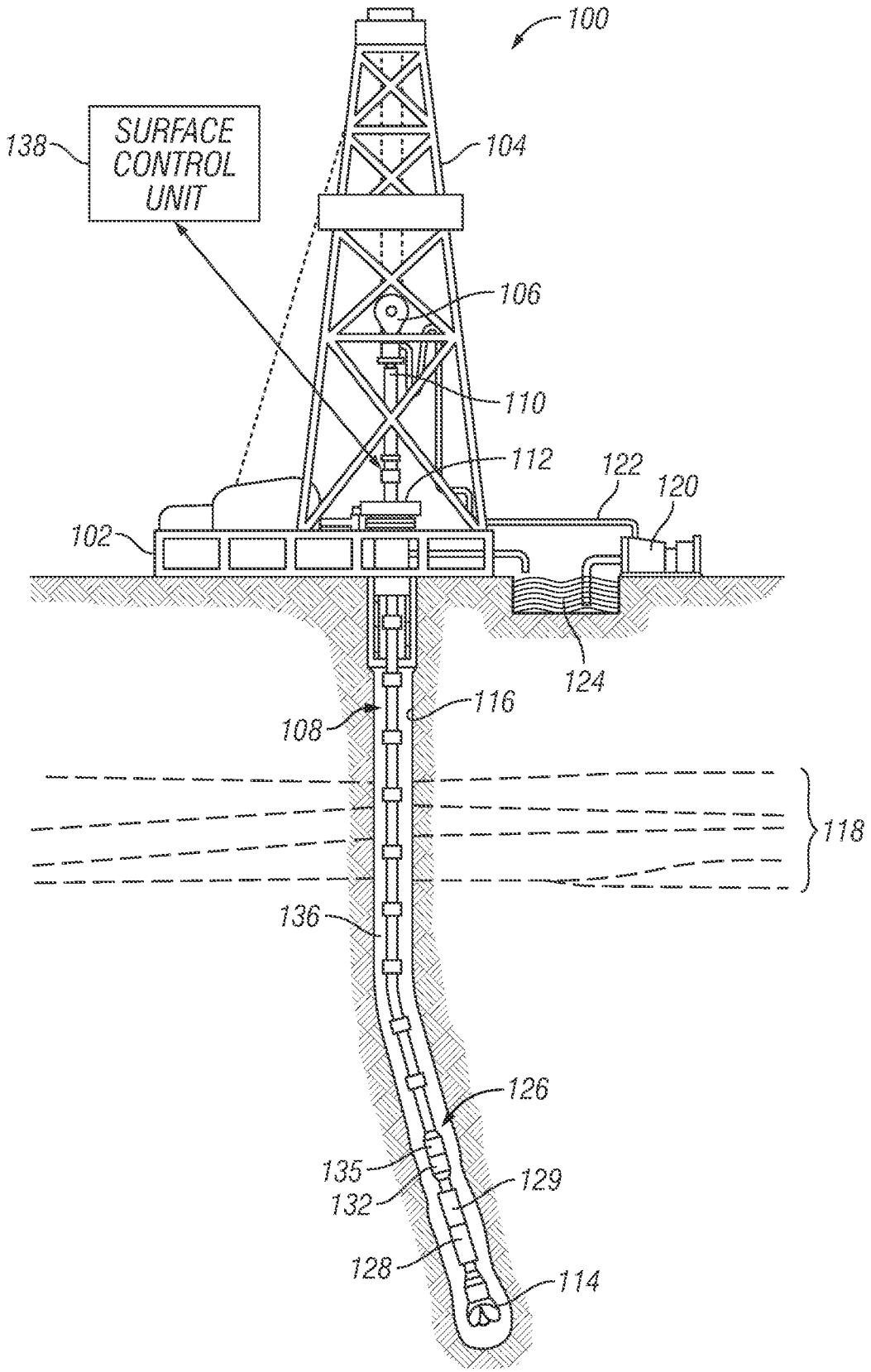
FIG. 1 is a schematic view of a drilling operation utilizing a directional drilling system in accordance with one or more embodiments of the present disclosure.

Turning now to the figures, FIG. 1 depicts a schematic view of a drilling operation utilizing a directional drilling system 100, in accordance with one or more embodiments. The system of the present disclosure will be specifically described below such that the system is used to direct a drill bit in drilling a borehole, such as a subsea well or a land well. Further, it will be understood that the present disclosure is not limited to only drilling an oil well. The present disclosure also encompasses natural gas boreholes, other hydrocarbon boreholes, or boreholes in general. Further, the present disclosure may be used for the exploration and formation of geothermal boreholes intended to provide a source of heat energy instead of hydrocarbons.

Accordingly, FIG. 1 shows a schematic view of a tool string 126 disposed in a directional borehole 116, in accordance with one or more embodiments. The tool string 126 includes a rotary steerable tool 128 in accordance with various embodiments. The rotary steerable tool 128 provides directional control of the drill bit 114 in three dimensions (e.g., in the x, y, and z axis in the Cartesian coordinate system). A drilling platform 102 supports a derrick 104 having a traveling block 106 for raising and lowering a drill string 108. A kelly 110 supports the drill string 108 as the drill string 108 is lowered through a rotary table 112. In one or more embodiments, a topdrive is used to rotate the drill string 108 in place of the kelly 110 and the rotary table 112. A drill bit 114 is positioned at the downhole end of the tool string 126, and, in one or more embodiments, may be driven by a downhole motor 129 positioned on the tool string 126 and/or by rotation of the entire drill string 108 from the surface.

As the bit 114 rotates, the bit 114 creates the borehole 116 that passes through various formations 118. A pump 120 circulates drilling fluid (alternatively referred to as drilling mud or simply as mud) through a feed pipe 122 and downhole through the interior of drill string 108, through orifices in drill bit 114. The drilling fluid then flows back to the surface via the annulus 136 around drill string 108 and into a retention pit 124. The drilling fluid transports cuttings from the borehole 116 into the pit 124 and aids in maintaining the integrity of the borehole 116. The drilling fluid may also drive the downhole motor 129 and other portions of the rotary steerable tool 128, such as extendable members for the tool 128.

The tool string 126 may include one or more logging while drilling (LWD) or measurement-while-drilling (MWD) tools 132 that collect measurements relating to various borehole and formation properties as well as the position of the bit 114 and various other drilling conditions as the bit 114 extends the borehole 108 through the formations 118. The LWD/MWD tool 132 may include a device for measuring formation resistivity, a gamma ray device for measuring formation gamma ray intensity, devices for measuring the inclination and azimuth of the tool string 126, pressure sensors for measuring drilling fluid pressure, temperature sensors for measuring borehole temperature, etc.

The tool string 126 may also include a telemetry module 135. The telemetry module 135 receives data provided by the various sensors of the tool string 126 (e.g., sensors of the LWD/MWD tool 132), and transmits the data to a surface unit 138. Data may also be provided by the surface unit 138, received by the telemetry module 135, and transmitted to the tools (e.g., LWD/MWD tool 132, rotary steering tool 128, etc.) of the tool string 126. In one or more embodiments, mud pulse telemetry, wired drill pipe, acoustic telemetry, or other telemetry technologies known in the art may be used to provide communication between the surface control unit 138 and the telemetry module 135. In one or more embodiments, the surface unit 138 may communicate directly with the LWD/MWD tool 132 and/or the rotary steering tool 128. The surface unit 138 may be a computer stationed at the well site, a portable electronic device, a remote computer, or distributed between multiple locations and devices. The unit 138 may also be a control unit that controls functions of the equipment of the tool string 126.

The rotary steerable tool 128 is configured to change the direction of the tool string 126 and/or the drill bit 114, such as based on information indicative of tool 128 orientation and a desired drilling direction or well profile. In one or more embodiments, the rotary steerable tool 128 is coupled to the drill bit 114 and drives rotation of the drill bit 114. Specifically, the rotary steerable tool 128 rotates in tandem with the drill bit 114. Further, in one or more embodiments, the rotary steerable tool 128 is a push-the-bit system.

Figure 2A:
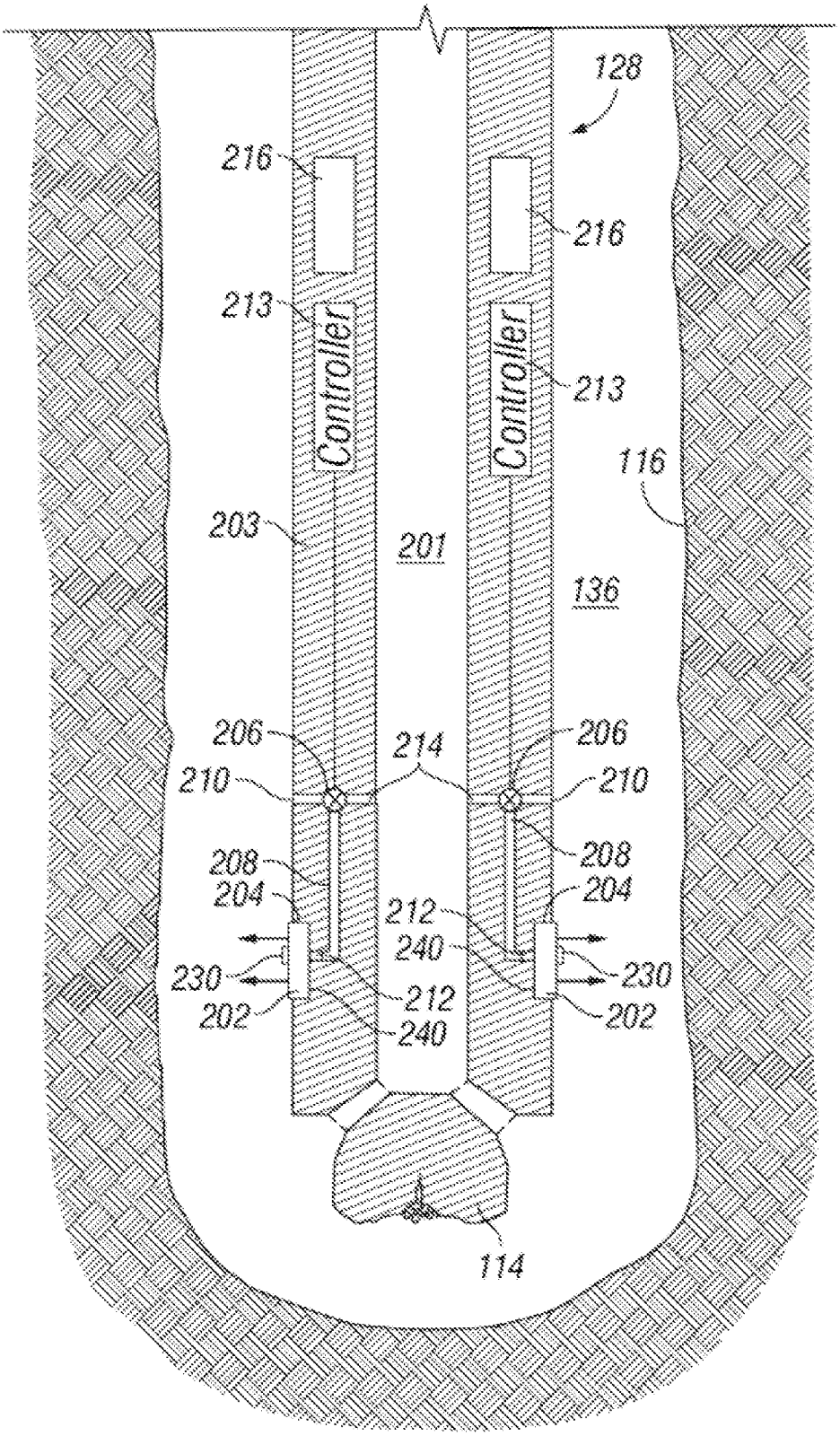
FIG. 2A is a radial cross-sectional schematic view of a rotary steerable tool in accordance with one or more embodiments of the present disclosure.

FIG. 2A depicts a radial cross-sectional schematic view of the rotary steerable tool 128 in the borehole 116 in accordance with one or more embodiments of the present disclosure. The tool 128 includes extendable members for selectively pushing against the wall of the borehole 116. An extendable member, in accordance with the present disclosure, may include a pad 202 and/or a piston 212 to push against the wall of the borehole 116 and urge the drill bit 114 in a direction. A rotary steerable tool within the scope of the present disclosure may alternatively include other types of extendable members or mechanisms, in addition or in alternative to the pads, including but not limited to pistons configured to push against the borehole wall directly without visually distinct or separate pads.

The rotary steerable tool 128 includes a tool body 203 and a flowbore 201 through which pressurized drilling fluid flows. As shown, the pads 202 are in a fully-retracted position, close to the tool body 203, and are movable over a range of movement defined between the fully-retracted position and a fully-extended position, as further described below. Generally, the pads 202 may be radially moveable with respect to the tool body 203 either by linear translation of the pads or by pivoting the pads. In the illustrated example, the pads 202 are pivotably coupled to the tool body 203 about hinges 204, and are thereby pivotable between the retracted and extended positions, such as via the hinges 204. Over their range of movement, pivoting of the pads 202 includes a radial component of movement; thus, pivoting the pads 202 outwardly moves them radially outwardly toward the borehole 116, and vice-versa. In the illustrated embodiment, the tool body 203 includes optional recesses 240, which receive the pads 202 when in the fully-retracted position, thereby allowing the pads 202 to be flush with the tool body 203. Further, a piston 212 included within each extendable member is engageable with each respective pad 202 and may be selectively actuated to forcibly extend the pistons 212. Thus, as further described below, the pistons 212 may be controlled to urge the pads 202 outwardly in a coordinated manner to control the direction of drilling.

The pads 202 are moveable to any of a range of possible positions within their maximum range of travel, which is typically mechanically limited to an angular range of movement sufficient for steering. An "extended position" may refer to any position in which the pad 202 is extended outwardly beyond the fully-retracted position, and not necessarily fully extended. In use, the desired rate of steering may be achieved without fully-extending the pads 202, although for a given mode of use, and all other parameters being held constant (e.g. constant formation composition, steady rate of rotation of the drill string, etc.), increasing extension will tend to increase the rate of steering, which may be measured for example in the amount of deflection of the borehole trajectory for a given length of drilling. Similarly, "extension" or "extending" refers to movement of the pad 202 outwardly from its current position, toward but not necessarily all the way to a fully extended position. Conversely, "retraction" or "retracting" refers to the pad 202 moving inwardly, in this embodiment by the pad 202 pivoting inwardly, toward but not necessarily all the way to the fully retracted position.

A rotary steerable tool according to the present disclosure may include any number of pads, but typically includes a plurality of pads circumferentially spaced about the tool body. Although not strictly required, the pads are preferably evenly-spaced circumferentially. By way of example (and as better seen in FIG. 3), the rotary steerable tool 128 in this embodiment includes three pads 202 evenly spaced 120 degrees apart around the circumference of the tool 128. A number of components may cooperate in the outward movement to selectively engage the borehole wall, including the pad 202 and the piston 212 or other actuator that urges the pad 202 outwardly. Generally speaking, the pad 202 refers to the portion of the extendable member that would actually contact the borehole. The pad 202 may be suitably configured for contact with the borehole wall, such as by using sufficiently strong and wear-resistant materials and optionally having a relatively broad surface area (as compared to the piston) for frictionally contacting the borehole wall.

The extendable members, such as the pads 202 of the extendable members, may also include a retraction mechanism (e.g., a spring or other biasing mechanism) that urges the extendable members or the pads 202 toward a retracted or fully-retracted position. In some other embodiments, the extendable members or the pads 202 are configured to fall back into the retracted position when pressure applied by the drill fluid at the pads 202 drops. Although not strictly required, the pads 202 in the illustrated embodiments are coupled to the piston 212 and, thus, travel with the piston 212. The piston 212 is a one-way piston for forcibly urging the pad 202 outwardly, but a two-way piston could alternatively be used to forcibly urge the pad 202 inwardly or outwardly as desired. In the case of a one-way piston, the pads 202 may rely on engagement with the wall of the borehole 116, or a retraction mechanism, to move the pads 202 from the extended position towards the retracted position. In an optional mode of operation, the pads 202 may be operated as centralizers, in which all the pads 202 are held in an equally-extended position, radially-centralizing the rotary steerable tool 128 in the borehole 116.

For a push-the-bit system, the resultant force of all the actuated extendable members or pads 202 of the extendable members applied on the wall of the borehole 116 should be in the opposite direction as the desired driving direction of the drill bit 114. As the pads 202 are only put into the extended position when in the appropriate position(s) during rotation of the rotary steerable tool 128, the pads 202 are pulled or retract back to the tool once no longer in an appropriate position. In one or more embodiments, hydraulic pressure is directed to the desired pad 202 or an associated piston 212 of the extendable member to actuate the extension of the pad 202. However, any suitable means of actuation, including for example mechanical or electrical actuation, may be used.

As an example of hydraulic actuation, in one or more embodiments, the pistons 212 are hydraulically driven to extend the pads 202 by generating a pressure differential between the flowbore 201 of the tool string 126 and an exterior to the rotary steerable tool 128, such as the annulus 136 surrounding the tool string 126 and inside the borehole 116. As shown in this embodiment, the pistons 212 are each in fluid communication with the flowbore 201 via a pressurized fluid supply flow path 214 and an actuation flow path 208 formed in the tool body 203. The actuation flow path 208 may also be coupled to a bleed flow path 210 formed in the tool body which hydraulically couples to the annulus 136.

For controlling the movement of each pad 202, an actuator 206, such as a linear actuator, valve, or other type of flow control device, may be in fluid communication with the pressurized fluid supply flow path 214, the actuation flow path 208, at the respective piston 212, at the pad 202, or anywhere between the flowbore 201 and the pad 202. The actuator 206 selectively controls fluid pressure, such as from drilling fluid, from the flowbore 201, though the pressurized fluid supply flow path 214, and to the piston 212 of the extendable member. The actuator 206, thus, is used to selectively control and hydraulically couple or decouple the actuation flow path 208 from the pressurized fluid supply flow path 214. In doing so, the actuator 206 controls the fluid pressure applied to the respective piston 212, thereby controlling extension of the piston 212 and pad 202 of the extendable member.

Each piston 212 is in fluid communication with an individual actuator 206 with each actuator 206 being independently controllable, such as independently controlled with respect to each other or from another mechanism (e.g., a rotary valve that may be included within other embodiments). Thus, the extension of each piston 212 (and each pad 202) is independently controlled with respect to the other pistons 212. The actuator 206 can include a linear actuator, such as a spindle drive or a ball screw actuator, or various other types of linear actuators including a hydraulic actuator, a pneumatic actuator, a piezoelectric actuator, an electromechanical actuator, a linear motor, and/or a telescoping linear actuator. In other embodiments, the actuator is not be limited to a linear actuator, and may include, for example, a rotary actuator, a solenoid valve, or an electric motor among others.

Figure 2B:
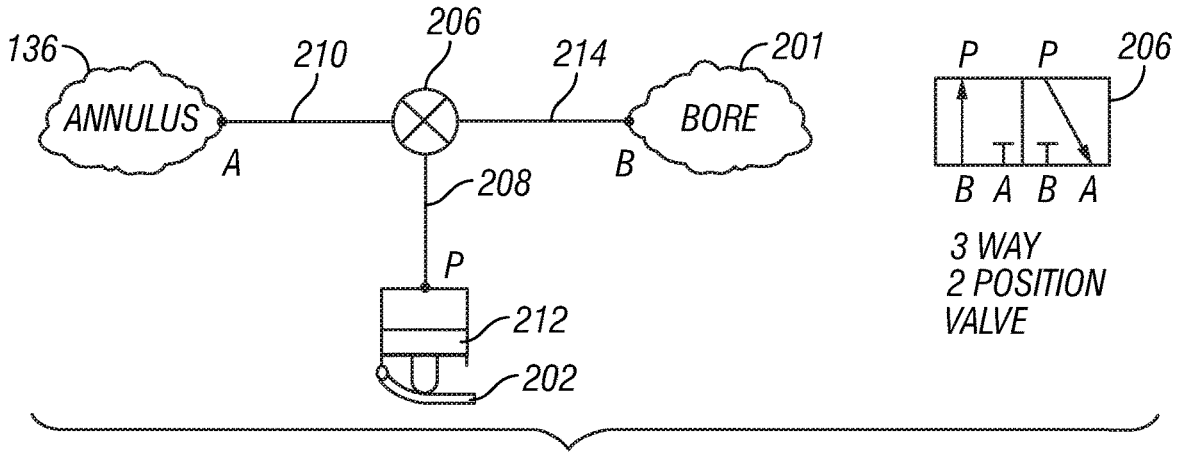
FIG. 2B is a schematic view of a fluid diagram of a rotary steerable tool in accordance with one or more embodiments of the present disclosure.

An example hydraulic circuit configuration includes, but is not limited to, the following configuration depicted in FIG. 2B. As shown in FIG. 2B, when the actuator 206 is actuated, the actuation flow path 208 and the pressurized fluid supply flow path 214 are coupled to the flowbore 201. Due to the pumping of drilling fluid into the flowbore 201 and the pressure drop at the bit 114, the flowbore 201 is at a higher pressure relative to the annulus 136. As a result, fluid pressure flows from the flowbore 201, into the pressurized fluid supply flow path 214, and into the actuation flow path 208. The increase in fluid pressure in the actuation flow path 208 actuates extension of the extendable member (e.g., the piston 212 and the pad 202). During actuation, the actuation flow path 208 is closed to the bleed flow path 210 and thus full differential fluid pressure between the flowbore 201 and annulus 136 is applied to the piston 212. During deactivation of the actuator 206, or retraction of the pad 202, the actuation flow path 208 is open to the bleed flow path 210 and the piston 212 is allowed to push the fluid to the annulus 136 via the bleed flow path 210. A choke valve, discussed more below, may be included within the bleed flow path 210 to regulate fluid flow between the piston 212 and the annulus 136 or exterior of the tool 128. Further, as discussed above in one or more embodiments, the pad 202 may be absent and the piston 212 pushes directly against the borehole 116.

Each piston 212 can be opened independently through actuation of the respective actuator 206. Any subset or all of the pistons 212 can be opened at the same time, in a staggered, overlapping scheme, or in any fashion that pushes the drill bit 114 in the desired direction at the desired location. In some embodiments, the actuators 206 are controlled by a central controller 213. In one or more embodiments, the amount of force by which a piston 212 or pad 202 pushes against the borehole 116 or the amount of extension may be controlled by controlling the fluid pressure from the flowbore 201, into the pressurized fluid supply flow path 214, and into the respective actuation flow path 208. This can be controlled via the actuator 206 or various other actuators or orifices placed along the actuation flow path 208 or the bleed flow path 210. This helps enable control over the degree of direction change of the drill bit 114.

The rotary steerable tool 128 may also contain one or more logging sensors 216 for making any measurement including measurement while drilling data, logging while drilling data, formation evaluation data, and other well data. The rotary steerable tool 128 may also include feedback sensors 230 that provide feedback regarding parameters such as pad displacement, force or pressure applied by an extendable member onto the borehole, force or pressure applied to extendable member (e.g., fluid pressure), force or pressure applied by the drill bit 114 onto the borehole, orientation and positional parameters of the extendable members, the drill bit 114 or tool 128, and the like. The feedback data is communicated to the central controller 213 and/or the surface control unit 138 and provides information for adjusting control of the rotary steerable tool 128 and/or the extendable members. The feedback sensors 230 may include but are not limited to strain gauges, Hall effect sensors, potentiometers, linear variable transformers, the like, and in any combination. The feedback sensors 230 are coupled to the various parts of the rotary steerable tool 128, the drill bit 114, the extendable members (e.g., pads 202 and/or pistons 212), among others, or the sensors may be remote to the rotary steerable tool 128.

Figure 3:
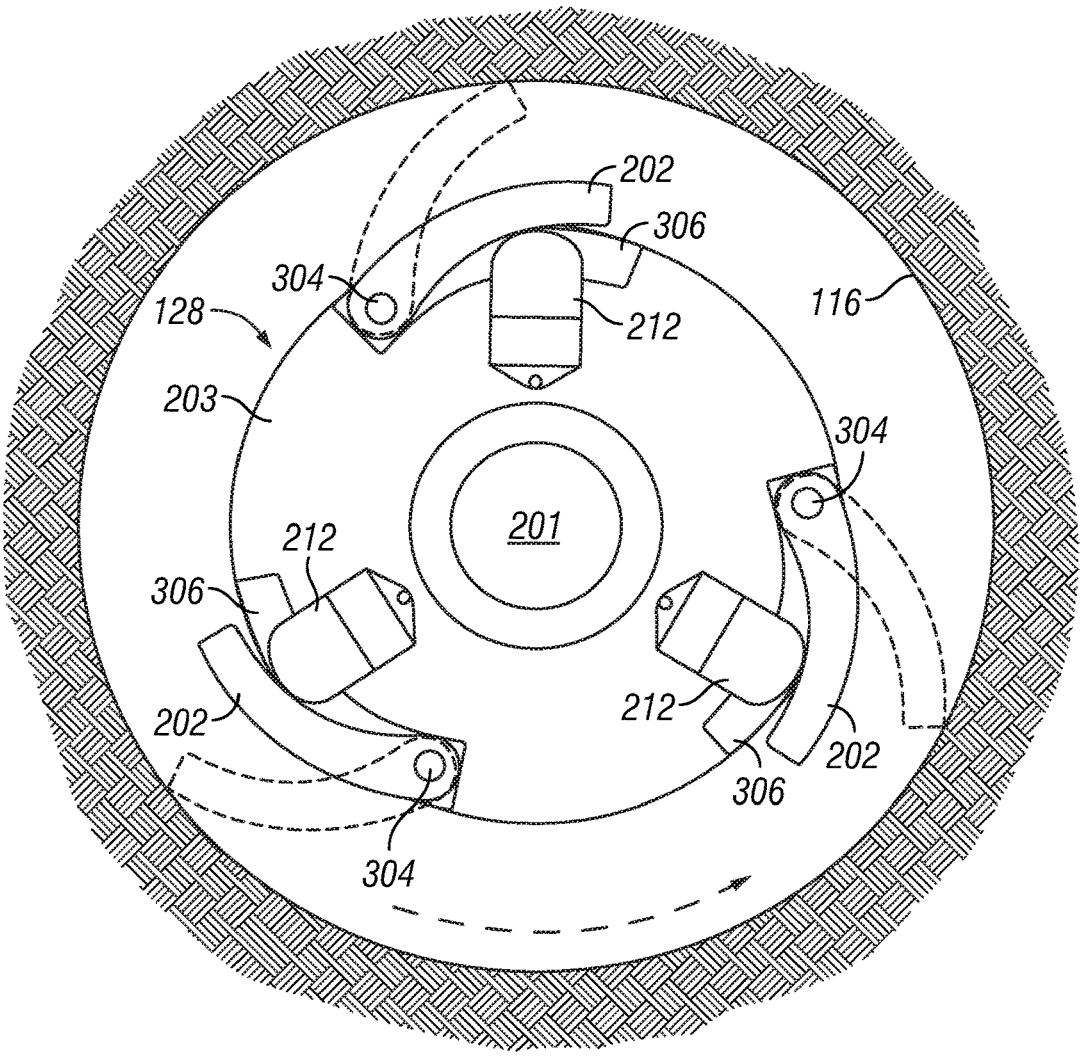
FIG. 3 is a radial cross-sectional schematic view of a rotary steerable tool in accordance with one or more embodiments of the present disclosure.

FIG. 3 depicts a radial cross-sectional schematic view of the rotary steerable tool 128 in accordance to one or more embodiments. As shown, the tool 128 includes extendable members, with the extendable members each including a pad 202 and a piston 212 in this embodiment. The pads 202 are close to the tool body 203 in a retracted position and movable outward into an extended position. In the illustrated example, the pads 202 are coupled to the tool body 203 and pivot between the retracted and extended positions via hinges 304. As mentioned above, the pads 202 can be pushed outward and into the extended position by the pistons 212. The tool body 203 includes recesses 306 that house the pads 202 when in the retracted position, thereby allowing the pads 202 to be flush with the tool body 203. The pads 202 can be extended to varying degrees. As discussed above, the "extended position" can refer to any position in which the pad 202 is extended outwardly beyond the retracted position and not necessarily fully extended. "Retraction" or "retracting" refers to the act of bringing the pad 202 inward, or moving the pad 202 from a more extended position to a less extended position, and does not necessarily refer to moving the pad 202 into a fully retracted position. Similarly, "extension" or "extending" refers to the act of moving the pad outward, such as from a less extended position to a more extended position, and does not necessarily refer to moving the pad 202 into a fully extended position.

Figure 4:
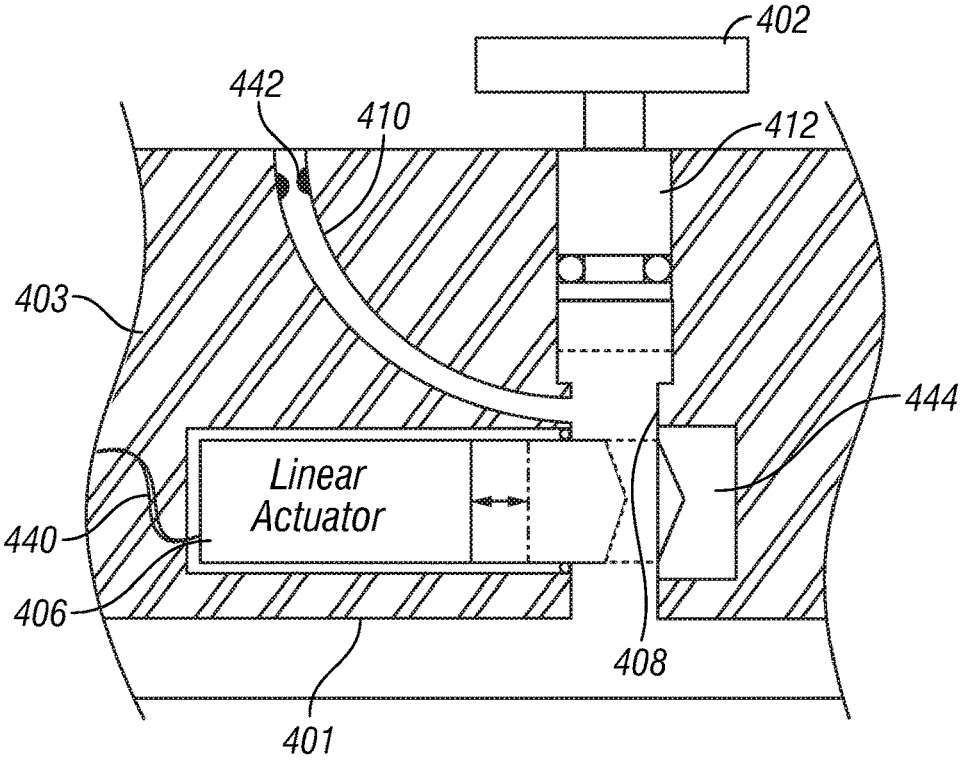
FIG. 4 is a cross-sectional schematic view of an actuator of a rotary steerable tool in accordance with one or more embodiments of the present disclosure.
Figure 5:
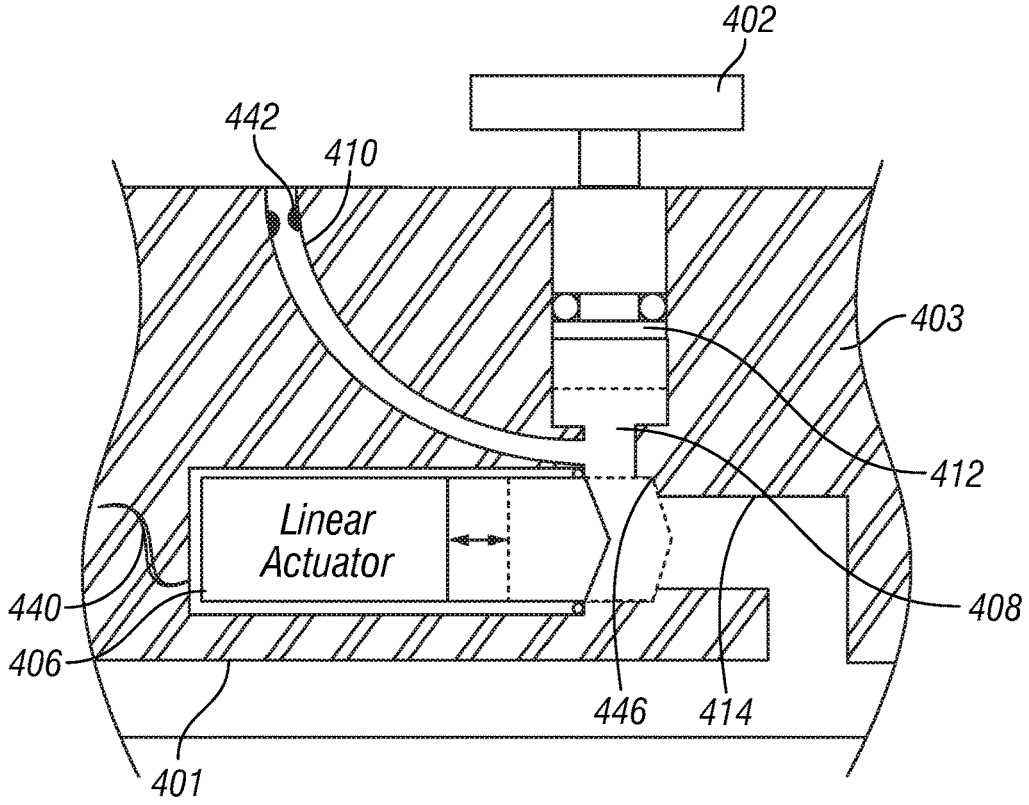
FIG. 5 is a cross-sectional schematic view of an actuator of a rotary steerable tool in accordance with one or more embodiments of the present disclosure.
Figure 6:
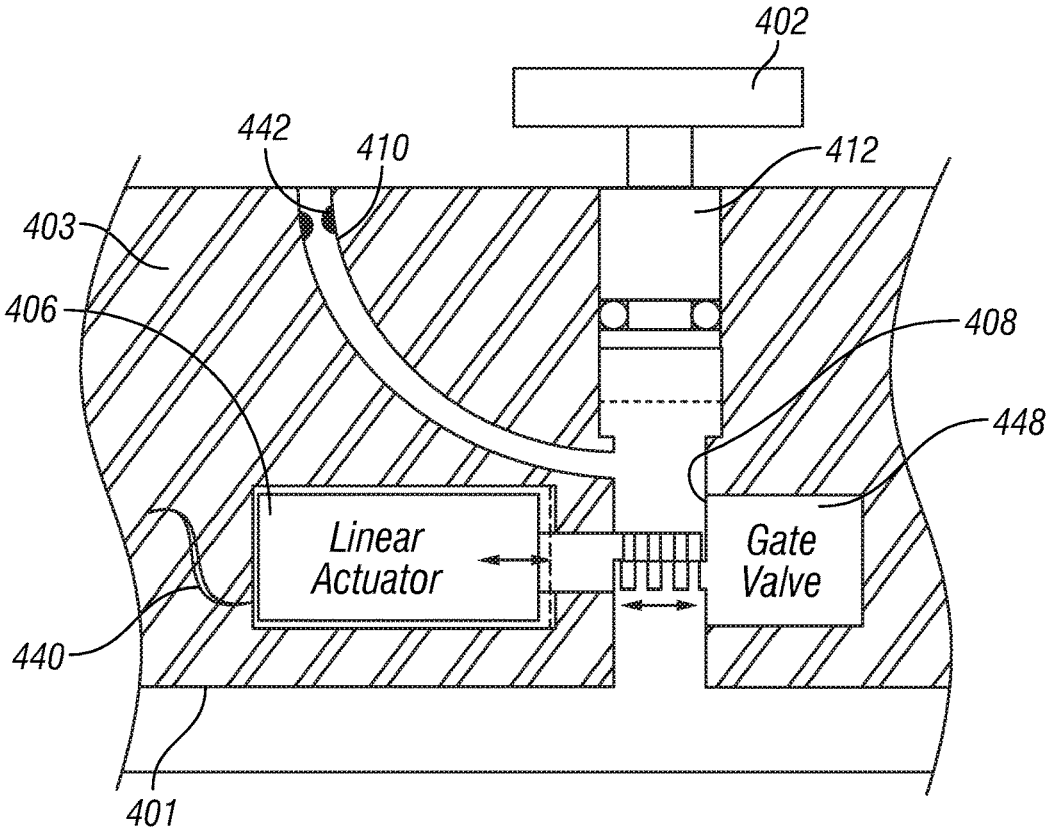
FIG. 6 is a cross-sectional schematic view of an actuator of a rotary steerable tool in accordance with one or more embodiments of the present disclosure.

Referring now to FIGS. 4-6, multiple schematic views of an actuator 406 included within a tool body 403 of a rotary steerable tool in accordance with one or more embodiments of the present disclosure are shown. The actuator 406 in these embodiments is shown as a linear actuator, in that the actuator 406 is used to create motion in a straight or linear line, as opposed to rotational or circular motion. Though the present disclosure is not limited to the use of only a linear actuator, a linear actuator may be able to be compact, have few moving parts, and otherwise be fairly durable for use within a downhole tool where these advantages may be particularly useful.

The actuator 406 is shown positioned within the tool body 403 and includes an electrical connection 440, such as for supplying power and/or control signals to the actuator 406. The tool body 403 includes a flowbore 401 therethrough, a pressurized fluid supply flow path 414 intersecting with and in fluid communication with the flowbore 401, an actuation flow path 408 in fluid communication with the pressurized fluid supply flow path 414, and a bleed flow path 410 intersecting with and in fluid communication with the actuation flow path 408. Further, as discussed above, an extendable member of a rotary steerable tool in accordance with the present disclosure may include a piston 412 and/or a pad 402. Accordingly, a piston 412 is positioned within and in fluid communication with the pressurized fluid supply flow path 414 and the actuation flow path 408 with a pad 402 operably coupled to the piston 412 such that the movement of the piston 412 may control the movement of the pad 402.

The actuator 406 controls pressurized fluid flow between the flowbore 401 and the piston 412 of the extendable member by selectively opening and closing to control fluid pressure through the pressurized fluid supply flow path 414 and/or the actuation flow path 408. In an open position (shown), the actuator 406 enables or allows pressurized fluid flow from the flowbore 401 to the piston 412, such as when moving the piston 412 from a retracted position to an extended position (shown). In a closed position, the actuator 406 prevents pressurized fluid flow from the flowbore 401 to the piston 412. In such a position, fluid pressure may flow through the bleed flow path 410 to the exterior of the tool body 403 to enable the piston 412 to move from the extended position to the retracted position.

In this embodiment, a choke valve 442 is positioned within and in fluid communication with the bleed flow path 410 to regulate fluid pressure between the piston 412 and the exterior of the tool body 403. The choke valve 442 still enables the piston 412, and the respective pad 402, to move from the extended position to the retracted position, but the choke valve 442 is able to provide resistance by restricting or regulating the fluid pressure when moving the piston 412. In an embodiment in which the bleed flow path 410 is not present, the actuator 406 may be used in the closed position to hydraulically lock the piston 412 and the pad 402 in position (such as in the extended position or the retracted position).

In each of FIGS. 4-6, the actuator 406 controls fluid pressure between the flowbore 401 and the extendable member, such as the piston 412 of the extendable member, thereby controlling movement of the piston 412 of the extendable member. In FIG. 4, the actuator 406 is positioned with respect to the pressurized fluid supply flow path 414 and the actuation flow path 408 such that the actuator 406, in the closed position, engages and seals against a seat 444 positioned within or adjacent the actuation flow path 408. In FIG. 5, the actuator 406 is positioned with respect to the pressurized fluid supply flow path 414 and the actuation flow path 408 such that the actuator 406, in the closed position, engages and seals against a recess 446 formed within the pressurized fluid supply flow path 414. In FIG. 6, a valve 448 (e.g., a gate valve in this embodiment) is positioned within or adjacent the pressurized fluid supply flow path 414 and the actuation flow path 408 to work in conjunction with the actuator 406 to control fluid pressure through the pressurized fluid supply flow path 414 and the actuation flow path 408.

Figure 7:
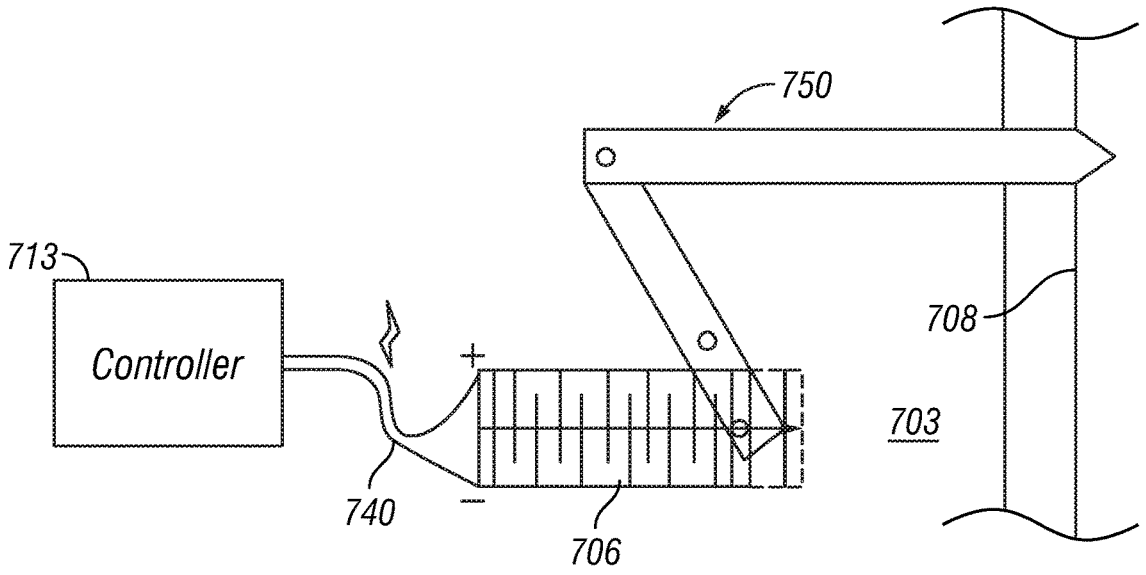
FIG. 7 is a cross-sectional schematic view of an actuator of a rotary steerable tool in accordance with one or more embodiments of the present disclosure.

Referring now to FIG. 7, a schematic view of an actuator 706 included within a tool body 703 of a rotary steerable tool in accordance with one or more embodiments of the present disclosure is shown. In this embodiment, the actuator 706 may be a linear actuator and a piezoelectric actuator. The actuator 706 is shown positioned within the tool body 703 and includes an electrical connection 740, such as for supplying power and/or control signals from a controller 713 to the actuator 706.

Further, in this embodiment, a mechanical amplifier 750 is included within the tool body 703 and is coupled to the actuator 706. A mechanical amplifier in accordance with the present disclosure may be used to increase the effective displacement, such as the linear displacement, of an actuator. Accordingly, in this embodiment, the mechanical amplifier 750 is shown as linkage mechanism or lever that is controlled and moved by the actuator 706. As the actuator 706 moves, the actuator 706 moves the linkage mechanism within or with respect to an actuation flow path 708 formed within the tool body 703. Thus, the movement of the actuator 706 is able to control fluid flow through the actuation flow path 708 using the mechanical amplifier, thereby also controlling movement of a piston and a pad in fluid communication with the actuation flow path 708. The present disclosure also contemplates the use of other types of mechanical amplifiers, such as a gear box, without departing from the scope of the present disclosure.

Figure 8:
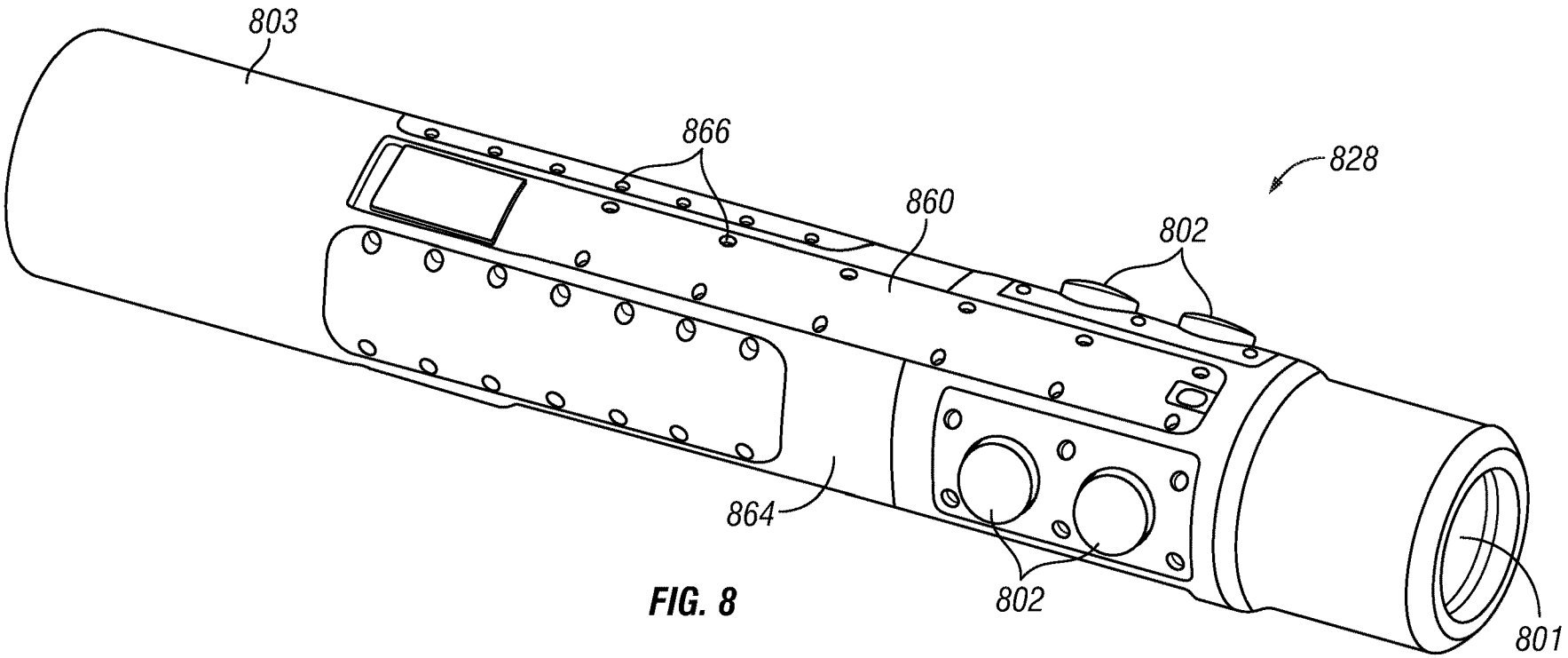
FIG. 8 is a perspective view of a rotary steerable tool in accordance with one or more embodiments of the present disclosure.
Figure 9:
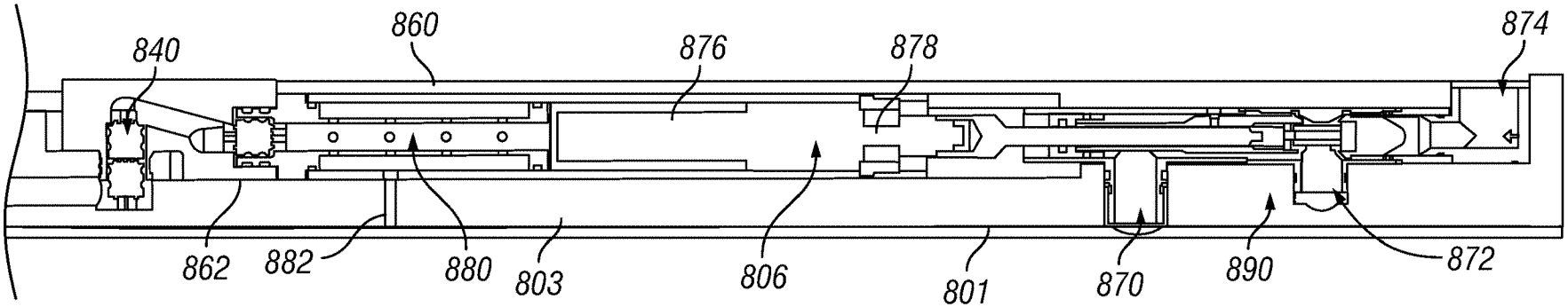
FIG. 9 is a cross-sectional view of an insert of a rotary steerable tool in accordance with one or more embodiments of the present disclosure.

Referring now to FIGS. 8 and 9, multiple views of a rotary steerable tool 828 including an insert 860 with an actuator 806 in accordance with one or more embodiments of the present disclosure is shown. In FIG. 8, a perspective view of the tool 828 with the insert 860 removably secured within a body 803 of the tool 828 is shown, and in FIG. 9, a cross-sectional view of the insert 860 removably secured within a recess 862 formed within the body 803 is shown. As the rotary steerable tool 828 may include multiple inserts 860, actuators, and extendable members (e.g., pads 802 of extendable members), the inserts 860 may be circumferentially positioned between the pads 802 of the extendable members with respect to an outer surface 864 of the tool 828. Further, the insert 860 may be removably secured within the tool body 803 using one or more securing mechanisms 866, such as a screw, bolt, or rivet.

As the insert 860 includes the actuator 806 positioned therein with the insert 860 removable with respect to the tool body 803, the insert 860 includes one or more inlets or outlets for controlling fluid flow or fluid pressure therethrough with the actuator 806. For example, as shown, the insert 860 includes a flowbore inlet 870 to receive fluid flow or fluid pressure from a flowbore 801 of the tool body 803 or a pressurized fluid supply flow path of the tool body 803 into the insert 860. Further, the insert 860 includes a piston outlet 872 to discharge or provide fluid pressure from the insert 860 to a piston of an extendable member, and includes an exterior outlet 874 to discharge fluid pressure from the insert 860 to out of the tool body 803. In this embodiment, the exterior outlet 874 is used to discharge fluid flow to the outer surface 864 of the tool 828. The actuator 806 is then movable within the insert 860 to control fluid flow and pressure between the flowbore inlet 870, the piston outlet 872, and/or the exterior outlet 874 using a valve 890 (e.g., a three-way valve in this embodiment).

By having the actuator 806 included within the insert 860, the actuator 806 is removable and replaceable within the tool 828. For example, if the actuator 806 becomes damaged, or a different type of actuator 806 with a different size or configuration is desired, the insert 860 is removable and replaced with another appropriate insert 860. In the embodiment shown in FIG. 9, the actuator 806 is a linear actuator that includes an electric motor 876 (e.g., a brushless DC electric motor) operably coupled to a spindle drive 878. The actuator 806 receives power through an electrical connection 840 of the insert 860 for moving and controlling the actuator 806 within the insert 860. Alternatively, a power source, such as a battery, may be included within the insert 860 for providing power to the actuator 806. The electric motor 876 uses power from the electrical connection 840 (and/or another power source) to rotate and linearly move the spindle drive 878, thereby linearly moving the valve 890 between positions. As the actuator 806 moves within the insert 860, the insert 860 further includes a compensator 880, such as a bladder compensator. The compensator 880 regulates pressure within the insert 860 as the actuator 806 and other components move within the insert 860. Further, in this embodiment, a vent passage 882 within the insert 860 and/or the body 803 vents pressure between the compensator 880 of the insert 860 and the flowbore 801 of the tool body 803.

As discussed above, an actuator and/or a choke valve may be used to control fluid flow and pressure between an extendable member (e.g., a piston) and an exterior of a body of a rotary steerable tool. For example, in FIGS. 8 and 9, the actuator 806 controls fluid flow between a piston through the piston outlet 872 and the outer surface 864 of the tool body 803. However, the present disclosure is not so limited, as the actuator, the flow paths, and/or the outlets may be formed such that fluid may flow back to the flowbore formed through the tool body instead to the outer surface.

Figure 10:
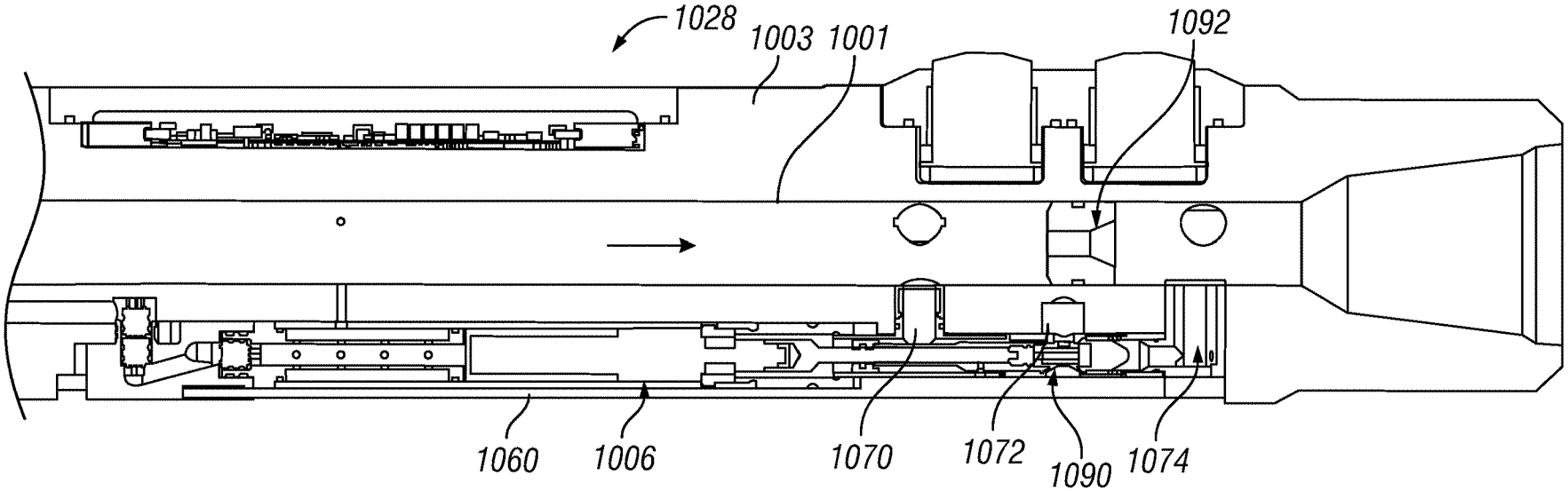
FIG. 10 is a cross-sectional view of a rotary steerable tool in accordance with one or more embodiments of the present disclosure.

Accordingly, FIG. 10 shows an embodiment in accordance with the present disclosure in which an actuator 1006 controls fluid flow back to a flowbore 1001. In this embodiment, the actuator 1006 is included within an insert 1060 that is removably secured within a body 1003 of a rotary steerable tool 1028. The actuator 1006 is movable within the insert 1060 to control fluid flow and pressure between the flowbore inlet 1070, the piston outlet 1072, and the exterior outlet 1074 using the valve 1090. The exterior outlet 1074, though, discharges fluid pressure to the flowbore 1001, as opposed to outside into the annulus in previous embodiments. In such an embodiment, a flow restrictor 1092 or orifice is positioned within the flowbore 1001 of the tool 1028. The outlet 1074 is positioned within the flowbore 1001 downstream of the flow restrictor 1092 to decrease the fluid pressure at the location of the outlet 1074 and enable fluid flow through the valve 1090.

This present disclosure may provide a rotary steerable tool with independent control of a plurality of extendable members with respect to each other, such that the extendable members (e.g., pistons and/or pads) can be operated at any sequence. This allows for sophisticated drilling control, including higher dogleg capability, force balancing, the ability to control extension frequency of pad extensions on the fly, correction of tool face offset, and adapting to drilling disturbance such as stick-slip. Further, the present disclosure may reduce the need for counter-rotating elements within a rotary steerable tool, such as for geo-stationary purposes, thereby reducing the complexity and number of moving parts within the tool.

In addition to the embodiments described above, many examples of specific combinations are within the scope of the disclosure, some of which are detailed below:

Embodiment 1. A rotary steerable tool for directional drilling, comprising:

a tool body including a flowbore for flowing pressurized fluid therethrough;

a plurality of extendable members movably coupled to the tool body for selectively engaging a borehole wall, each extendable member including a piston for moving the extendable member to an extended position;

a pressurized fluid supply flow path to provide fluid pressure from the flowbore to the pistons; and a plurality of linear actuators, each independently actuatable to control fluid pressure from the pressurized fluid supply flow path to a respective piston.

Embodiment 2. The tool of Embodiment 1, wherein each extendable member further includes a pad coupled a respective piston for contacting the borehole wall.

Embodiment 3. The tool of Embodiment 1, wherein the pressurized fluid supply flow path comprises a plurality of pressurized fluid supply flow paths, each corresponding to a respective linear actuator.

Embodiment 4. The tool of Embodiment 1, wherein each of the linear actuators further independently controls fluid pressure out of the tool body.

Embodiment 5. The tool of Embodiment 1, wherein an insert removably securable within the tool body comprises at least one of the plurality of linear actuators.

Embodiment 6. The tool of Embodiment 5, wherein the insert further comprises:

a flowbore inlet to receive fluid pressure from the pressurized fluid supply flow path;

an exterior outlet to discharge fluid pressure out of the tool body;

a piston outlet to provide fluid pressure to the piston; and wherein the linear actuator is arranged and actuatable to control fluid pressure between the flowbore inlet, the exterior outlet, and the piston outlet.

Embodiment 7. The tool of Embodiment 5, wherein the insert comprises a plurality of inserts such that each insert comprises a respective one of the plurality of linear actuators.

Embodiment 8. The tool of Embodiment 1, wherein at least one of the plurality of linear actuators comprises a ball screw and is electrically powered.

Embodiment 9. The tool of Embodiment 1, wherein at least one of the plurality of linear actuators comprises a piezoelectric actuator.

Embodiment 10. The tool of Embodiment 9, further comprising a mechanical amplifier coupled to the piezoelectric actuator to increase the linear displacement of the piezoelectric actuator.

Embodiment 11. The tool of Embodiment 1, further comprising a plurality of choke valves, each corresponding to a respective piston to regulate fluid pressure from the respective piston to out of the tool body.

Embodiment 12. A method of directionally drilling a borehole, comprising:

rotating a tool within the borehole, the tool comprising:

a tool body including a flowbore;

a plurality of extendable members movably coupled to the tool body, each extendable member including a piston;

a pressurized fluid supply flow path from the flowbore to the pistons; and a plurality of linear actuators, each corresponding to a respective piston; and independently moving one of the plurality of linear actuators with respect to another to selectively provide fluid pressure from the pressurized fluid supply flow path to the respective piston, thereby moving the respective extendable member of the respective piston to an extended position to engage a borehole wall of the borehole and push the tool in a target direction.

Embodiment 13. The method of Embodiment 12, wherein the pressurized fluid supply flow path comprises a plurality of pressurized fluid supply flow paths, each pressurized fluid supply flow path corresponding to a respective one of the plurality of linear actuators, the method further comprising:

independently moving each of the plurality of linear actuators with respect to each other to selectively provide fluid pressure from a respective pressurized fluid supply flow path to the respective piston.

Embodiment 14. The method of Embodiment 12, further comprising regulating fluid pressure from the respective piston to out of the tool body with a choke valve.

Embodiment 15. The method of Embodiment 12, further comprising removing an insert comprising at least one of the plurality of linear actuators from the tool body and replacing with a replacement insert comprising a replacement linear actuator.

Embodiment 16. A rotary steerable tool for directional drilling, comprising:

a tool body including a flowbore for flowing pressurized fluid therethrough;

an extendable member movably coupled to the tool body for selectively engaging a borehole wall, the extendable member including a piston for moving the extendable member to the extended position;

a pressurized fluid supply flow path to provide fluid pressure from the flowbore to the piston; and an insert removably securable within the tool body, the insert comprising an actuator to selectively control fluid pressure from the pressurized fluid supply flow path to the piston.

Embodiment 17. The tool of Embodiment 16, wherein the insert further comprises:

a flowbore inlet to receive fluid pressure from the pressurized fluid supply flow path;

an exterior outlet to discharge fluid pressure out of the tool body;

a piston outlet to provide fluid pressure to the piston; and wherein the actuator is arranged and actuatable to control fluid pressure between the flowbore inlet, the exterior outlet, and the piston outlet.

Embodiment 18. The tool of Embodiment 17, wherein the insert further comprises an electrical connection to receive power for the actuator.

Embodiment 19. The tool of Embodiment 17, wherein the insert further comprises a power source positioned therein to provide power for the actuator.

Embodiment 20. The tool of Embodiment 17, further comprising a flow restrictor positioned within the flowbore of the tool body, wherein the exterior outlet discharges fluid pressure into the flowbore downstream of the flow restrictor.

One or more specific embodiments of the present disclosure have been described. In an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time-consuming, but would nevertheless be a routine undertaking of design, fabrication, and manufacture for those of ordinary skill having the benefit of this disclosure.

Certain terms are used throughout the description and claims to refer to particular features or components. As one skilled in the art will appreciate, different persons may refer to the same feature or component by different names. This document does not intend to distinguish between components or features that differ in name but not function.

Reference throughout this specification to "one embodiment," "an embodiment," "an embodiment," "embodiments," "some embodiments," "certain embodiments," or similar language means that a particular feature, structure, or characteristic described in connection with the embodiment may be included in at least one embodiment of the present disclosure. Thus, these phrases or similar language throughout this specification may, but do not necessarily, all refer to the same embodiment.

The embodiments disclosed should not be interpreted, or otherwise used, as limiting the scope of the disclosure, including the claims. It is to be fully recognized that the different teachings of the embodiments discussed may be employed separately or in any suitable combination to produce desired results. In addition, one skilled in the art will understand that the description has broad application, and the discussion of any embodiment is meant only to be exemplary of that embodiment, and not intended to suggest that the scope of the disclosure, including the claims, is limited to that embodiment.

What is claimed is:

1. A rotary steerable tool for directional drilling, comprising:

a tool body including a flowbore for flowing pressurized fluid therethrough;

a plurality of extendable members movably coupled to the tool body for selectively engaging a borehole wall, each extendable member including a piston for moving the extendable member to an extended position;

a pressurized fluid supply flow path to provide fluid pressure from the flowbore to the pistons;

a plurality of linear actuators, each independently actuatable to control fluid pressure from the pressurized fluid supply flow path to a respective piston; and an insert removably securable within the tool body comprising at least one of the plurality of linear actuators, the insert comprising:

a flowbore inlet to receive fluid pressure from the pressurized fluid supply flow path;

an exterior outlet to discharge fluid pressure out of the tool body; and a piston outlet to provide fluid pressure to the piston;

wherein the linear actuator is arranged and actuatable to control fluid pressure between the flowbore inlet, the exterior outlet, and the piston outlet.

2. The tool of claim 1, wherein each extendable member further includes a pad coupled a respective piston for contacting the borehole wall.

3. The tool of claim 1, wherein the pressurized fluid supply flow path comprises a plurality of pressurized fluid supply flow paths, each corresponding to a respective linear actuator.

4. The tool of claim 1, wherein each of the linear actuators further independently controls fluid pressure out of the tool body.

5. The tool of claim 1, wherein the insert comprises a plurality of inserts such that each insert comprises a respective one of the plurality of linear actuators.

6. The tool of claim 1, wherein at least one of the plurality of linear actuators comprises a ball screw and is electrically powered.

7. The tool of claim 1, wherein at least one of the plurality of linear actuators comprises a piezoelectric actuator.

8. The tool of claim 7, further comprising a mechanical amplifier coupled to the piezoelectric actuator to increase the linear displacement of the piezoelectric actuator.

9. The tool of claim 1, further comprising a plurality of choke valves, each corresponding to a respective piston to regulate fluid pressure from the respective piston to out of the tool body.

10. A method of directionally drilling a borehole, comprising:

rotating a tool within the borehole, the tool comprising:

a tool body including a flowbore;

a plurality of extendable members movably coupled to the tool body, each extendable member including a piston;

a pressurized fluid supply flow path from the flowbore to the pistons; and a plurality of linear actuators, each corresponding to a respective piston; and independently moving one of the plurality of linear actuators with respect to another to selectively provide fluid pressure from the pressurized fluid supply flow path to the respective piston, thereby moving the respective extendable member of the respective piston to an extended position to engage a borehole wall of the borehole and push the tool in a target direction;

wherein an insert removably securable within the tool body comprises at least one of the plurality of linear actuators, the insert comprising:

a flowbore inlet to receive fluid pressure from the pressurized fluid supply flow path;

an exterior outlet to discharge fluid pressure out of the tool body; and a piston outlet to provide fluid pressure to the piston;

wherein the linear actuator is arranged and actuatable to control fluid pressure between the flowbore inlet, the exterior outlet, and the piston outlet.

11. The method of claim 10, wherein the pressurized fluid supply flow path comprises a plurality of pressurized fluid supply flow paths, each pressurized fluid supply flow path corresponding to a respective one of the plurality of linear actuators, the method further comprising:

independently moving the plurality of linear actuators with respect to each other to selectively provide fluid pressure from a respective pressurized fluid supply flow path to the respective piston.

12. The method of claim 10, further comprising regulating fluid pressure from the respective piston to out of the tool body with a choke valve.

13. The method of claim 10, further comprising removing the insert from the tool body and replacing with a replacement insert comprising a replacement linear actuator.

14. A rotary steerable tool for directional drilling, comprising:

a tool body including a flowbore for flowing pressurized fluid therethrough;

an extendable member movably coupled to the tool body for selectively engaging a borehole wall, the extendable member including a piston for moving the extendable member to the extended position;

a pressurized fluid supply flow path to provide fluid pressure from the flowbore to the piston; and an insert removably securable within the tool body comprising an actuator, the insert further comprising:

flowbore inlet to receive fluid pressure from the pressurized fluid supply flow path;

an exterior outlet to discharge fluid pressure out of the tool body; and a piston outlet to provide fluid pressure to the piston;

wherein the actuator arranged and actuatable to selectively control fluid pressure from the pressurized fluid supply flow path to the piston and fluid pressure between the flowbore inlet, the exterior outlet and the piston outlet.

15. The tool of claim 14, wherein the insert further comprises an electrical connection to receive power for the actuator.

16. The tool of claim 14, wherein the insert further comprises a power source positioned therein to provide power for the actuator.

17. The tool of claim 14, further comprising a flow restrictor positioned within the flowbore of the tool body, wherein the exterior outlet discharges fluid pressure into the flowbore downstream of the flow restrictor.

* * * * *